United States Patent [19]

Meisner et al.

[11] 4,429,833

[45] Feb. 7, 1984

[54] PROCESS AND DEVICE FOR DELIVERING A LIQUID ONTO A ROTATING AND HOLLOW BODY

[75] Inventors: Roland Meisner, Schorndorf; Hagen Buchholz, Münster, both of Fed. Rep. of Germany

[73] Assignee: BASF Farben & Fasern AG, Hamburg, Fed. Rep. of Germany

[21] Appl. No.: 326,037

[22] Filed: Nov. 30, 1981

[30] Foreign Application Priority Data

Dec. 18, 1980 [DE] Fed. Rep. of Germany ..... 3047670

[51] Int. Cl.[3] ..... B05B 3/10

[52] U.S. Cl. ..... 239/224

[58] Field of Search ..... 239/3, 7, 700–703, 239/223, 224, 486

[56] References Cited

U.S. PATENT DOCUMENTS 2,161,016 6/1939 Carr ..... 239/486 X 2,728,606 12/1955 Smart et al. ..... 239/224

3,000,574 9/1961 Sedlacsik, Jr. ..... 239/703

FOREIGN PATENT DOCUMENTS 18917 of 1912 United Kingdom ..... 239/223

*Primary Examiner*—Andres Kashnikow

*Attorney, Agent, or Firm*—Wells & Wells

[57] ABSTRACT

The invention relates to a process and a device for transferring a liquid from a stationary feeding component onto a working part which is rotationally driven, for example a spraying-bell, by generating a thin sheet of liquid in the shape of a conical shell, which is stable over a distance of travel which can be defined, it being possible to define the apex angle of this shell in terms of the functional parameters of the liquid, so that it is possible to select different impact positions of the thin sheet of liquid on the transfer portion of the spraying-bell, depending on the particular liquid in question.

5 Claims, 1 Drawing Figure

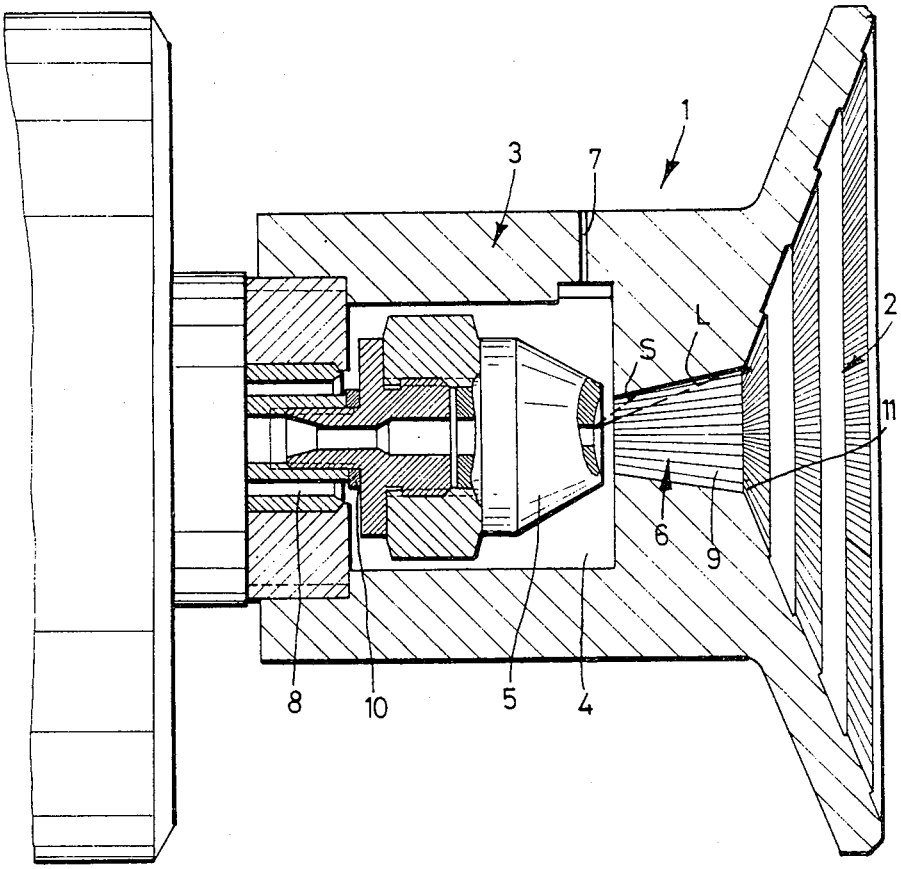
1
3
7
2
L
S
11
6
9
8
10
5
4

PROCESS AND DEVICE FOR DELIVERING A LIQUID ONTO A ROTATING AND HOLLOW BODY

The invention relates to a process for delivering a liquid e.g. a liquid coating agent, from a stationary feeding component, onto the curved inner surface of a rotating hollow body, e.g. of a spraying-bell. The invention further relates to a device for carrying out a process of this type.

It is known, in practice, to introduce a liquid into a hollow body, eccentrically with respect to its axis of rotation, with the aid of a tube, and thence to spray the liquid radially or tangentially onto the curved inner surface.

In another known embodiment, the axis of rotation is designed as a hollow shaft, which projects only partially into the hollow body, that is the spraying-bell, and through which the liquid is sprayed, centrally with respect to the spin axis and via a nozzle, onto a system of baffle-plates, this system being intended to effect homogeneous distribution of the liquid over the curved inner surface of the hollow cone.

Finally, it is known to employ a hollow shaft, which directly effects the transfer of the liquid onto the curved inner surface by simple running-out.

All these known embodiments and procedures are subject to the disadvantage, among others, that they do not entail the certainty that the liquid continuously flows over all the surfaces which it has wetted, thus providing an automatic cleaning action.

On the contrary, it is demanded, in practice, that the moving body should move at a high angular velocity, so that it is impossible to employ mechanical seals. It is further demanded that the fluid should not fill the cavity within the rotating body, but must be homogeneously distributed over the interior surface of the cavity, and that there should be no components at the transfer point which are not continuously washed and rinsed by the liquid, so that automatic cleaning takes place when the liquid is changed.

It is an object of the present invention to satisfy these practical requirements.

Starting from an installation according to the preamble, we have found that this object is achieved, according to the invention, by a process wherein a rotational flow is imparted to the liquid in the stationary component, this rotational flow generating a thin sheet of liquid within the liquid as it leaves the stationary component, and after it has left this component, this thin sheet of liquid having the shape of a conical shell and being guided into a conical transfer surface on the spraying-bell, where it is accelerated and is thereafter guided to the edge of the spraying-bell.

In generating this thin sheet of liquid, a procedure is preferably followed whereby a subatmospheric pressure, the magnitude of which can be adjusted, is present at the outer surface of the conical sheet of liquid, whilst a pressure approximately equal to the atmospheric pressure is arranged to act on the inner surface of the conical sheet of liquid.

Finally, it is proposed that the liquid which generates the thin conical sheet of liquid be fed into the hollow-cone nozzle at a pressure which can be regulated, this pressure being adjustable in accordance with the viscosity of the liquid, and also as a function of the throughput.

The device for carrying out the process according to the invention comprises a stationary hollow-cone nozzle, for generating the thin sheet of liquid in the shape of a conical shell, and a transfer surface in the revolving spraying-bell, this transfer surface having the shape of a truncated hollow cone and being located opposite the mouth of the hollow-cone nozzle, at a distance therefrom, and tapering in the direction of the said nozzle.

Additional advantageous further developments of the device according to the invention are explained in the sub-claims.

The design solution according to the invention consequently comprises an arrangement wherein the fluid, that is to say, the liquid, is transferred to the hollow body, that is to say, therefore, to the spraying-bell, centrally with respect to the axis of rotation and by means of a thin sheet having the form of a hollow conical surface. This thin conical sheet is generated by a rotational flow which is suddenly no longer guided, and is acquired and taken up by the curved inner surface of the rotating hollow body, that is to say of the spraying-bell, and by the transfer surface in the shape of a truncated hollow cone, provided inside the bell, this process taking place before the thin sheet of liquid, after travelling a definable distance, disintegrates into drops. The thin conical sheet of liquid, and hence the transfer position, is so stable that liquid continuously flows over all the points which are wetted. On changing from one liquid to another, between which no mixing should be allowed, since they are mutually incompatible for predetermined reasons, a special cleaning fluid, having a lower specific gravity, is employed, or the pressure gradient at the thin sheet is altered, so that the impact position of the thin conical sheet of liquid is thereby altered. The thin conical sheet of liquid, thus generated, has a larger apex angle and consequently also coats zones which were not wetted by the previous thin sheet of liquid, so that it is always ensured that the transition positions can, for example, also be perfectly cleaned.

The thin conical sheet of liquid, transferred to the curved inner surface of the hollow cone, uniformly and symmetrically with respect to the axis of rotation, is accelerated by this curved inner surface and conveyed away from the delivery position by means of the centrifugal forces which arise at the same time. In this process, the acceleration can be obtained by friction, or by normal forces, which act on the thin sheet following its breakdown into threads of liquid.

In the text which follows, an illustrative embodiment of the invention is explained with the aid of the drawing.

At 1, the drawing shows a spraying-bell, which possesses a bell-shaped rotationally symmetrical hollow body 2, and a cylindrical end portion 3, this spraying-bell being driven at a rotational speed of 30,000 to 40,000 rpm.

The cylindrical end portion of the spraying-bell 1 is of hollow design, and a swirl nozzle 5 is located in the cavity this created, marked 4 in the drawing, this nozzle being of stationary design and serving to feed in the liquid which is to be sprayed. The transition made by the wall of the spraying-bell, from the bell-shaped portion 2 to the cavity 4, is effected via a transfer surface 6, which has the shape of a truncated hollow cone, and in which grooves are located, which extend parallel to the generatrix. The mouth of the transfer surface 6 of truncated hollow conical shape, is located at a distance from the mouth of the swirl nozzle 5.

A drilled hole is marked at 7, this hole passing radially through the wall of the cylindrical portion, and generating a sub-atmospheric pressure in the space 4 when the spraying-bell 1 is revolving.

At the same time, an air supply nozzle can be recognized at 8, this nozzle opening into the space 4, and being equipped with regulating devices (not represented in the drawing), which enable air to be supplied to the space 4 in a regulated manner, thereby enabling the sub-atmospheric pressure in the space to be established.

A seal, sealing off the swirl nozzle 5 with respect to the supply pipe, can be seen at 10.

The mode of operation of the device according to the invention, and the procedure for carrying out the process according to the invention are as follows:

In the swirl nozzle, a spinning motion is imposed on the liquid, for example a lacquer, this action being suddenly discontinued at the edge of the swirl nozzle 5, so that the liquid is broken up to form a thin sheet having the shape of a conical surface. This thin conical sheet of liquid possesses a velocity component in the axial direction and, in particular, such that it moves into the rotating hollow body, that is to say, onto the transfer surface 6, which has the shape of a truncated hollow cone. The transfer surface of the rotating hollow body is designed in such a way that it acquires the thin conical sheet of liquid without there being a position at which a discontinuity is present.

In order not to have then to accelerate the thin conical sheet of liquid to the speed of rotation by means of its viscous friction, the truncated hollow conical transfer surface is provided with the grooves 9, into which the thin sheet of liquid is deposited and thereby automatically distributes itself as individual flowing threads. The accelerating force now acts on these flowing threads, as a normal force, thus ensuring slip-free acceleration of the liquid. The individual flowing threads leave the truncated hollow conical transfer surface at the edge 11, in order to be subsequently distributed, in a uniform manner, on the curved inner surface of the hollow body, and to charge this inner surface.

It can be seen from the drawing, that the position at which the liquid is transferred in the truncated hollow conical transfer surface 6 is defined by the line L. This line L is situated lower down in the transfer surface than the line S, which represents the transfer position of the flushing agent. The angles of the thin conical sheet of liquid are determined by the specific parameters of the liquid.

If, however, this possibility does not suffice for a reliable separation of the two impact positions, the angle of the cone can also be altered by controlling the pressure on the rear surface of the thin conical sheet of liquid. This is effected by continuously pumping air from the cavity 4 surrounding the outside of the thin conical sheet of liquid which is formed, the air being pumped out via the drilled ventilating hole 7. The external pressure on the thin conical sheet of liquid can be defined by metering the air which is entering via the annular-gap nozzle 8. Atmospheric pressure prevails as the internal pressure of this thin conical sheet of liquid, and it is thereby possible to adjust the angle of the cone to the desired value.

We claim:

1. An apparatus to feed from a fixed feed part a fluid, for instance a liquid coating means, in the form of a liquid sheet shaped in the manner of a surface of a cone to the inner contour of a rotatable spray bell (1) having a bell-shaped hollow body (2) symmetrical about the axis of rotation thereof and having a cylindrical end part (3) where the fluid is accelerated and guided to a rim of the spray bell (1), a fixed hollow cone nozzle (5) at the feed end of the feed part to generate the liquid sheet in the form of a conical surface, and a transfer surface (6) spaced opposite the mouth of the hollow cone nozzle (5), having the shape of a hollow frustrum-of-cone, and located in the rotatable spray bell (1), said hollow frustrum-of-cone transfer surface (6) tapering toward the hollow conical nozzle (5), said hollow conical nozzle (5) being mounted in the cylindrical end part (3), and said hollow frustrum-of-cone transfer surface (6) being hollowed out between the bell-shaped hollow body (2) and the cylindrical end part (3).

2. An apparatus according to claim 1, including at least one radial bore (7) passing through the wall of the cylindrical end part (3) of the spray bell (1).

3. An apparatus according to claim 1, including air feed apertures (8) to the interior space (4) of the cylindrical end part (3) of the spray bell (1).

4. An apparatus according to claim 1, including grooves (9) on the interior of the hollow frustrum-of-cone transfer surface (6) parallel to the generatrix thereof.

5. An apparatus according to claim 1, including means for imparting an angular speed to the spray bell (1) of 15,000 rpm and higher.

* * * * *